United States Patent [19]

Pfeiffer et al.

[11] 4,318,680

[45] Mar. 9, 1982

[54] SPINNERETTE PLATE HAVING MULTIPLE CAPILLARIES PER COUNTERBORE FOR MELT SPINNING FUSION MELTS OF ACRYLONITRILE POLYMER AND WATER

[75] Inventors: Ronald E. Pfeiffer, Pensacola; Stanley E. Peacher, Milton, both of Fla.

[73] Assignee: American Cyanamid Company, Stamford, Conn.

[21] Appl. No.: 157,999

[22] Filed: Jun. 9, 1980

Related U.S. Application Data

[63] Continuation of Ser. No. 938,202, Aug. 30, 1978, abandoned.

[51] Int. Cl.[3] ..... B29F 3/04

[52] U.S. Cl. ..... 425/382.2; 425/464

[58] Field of Search ..... 425/466, 464, 382.2, 425/462, 131.5, 72 S; 264/176 F, 177 F

[56] References Cited

U.S. PATENT DOCUMENTS

| | | | |
|---|---|---|---|
| 197,564 | 4/1843 | Wempe | 425/382.2 |
| 2,465,408 | 3/1949 | Webb et al. | 425/382.2 |
| 3,454,986 | 7/1969 | Fassbender | 425/382.2 |
| 3,621,088 | 11/1971 | Hatcher et al. | 425/71 |
| 3,667,886 | 6/1972 | Gauthier et al. | 425/382.2 |
| 3,824,050 | 7/1974 | Balk | 425/382.2 |
| 3,857,665 | 12/1974 | Kennedy | 425/378 R |
| 4,248,577 | 2/1981 | Borg et al. | 264/176 F |

FOREIGN PATENT DOCUMENTS

| | | | |
|---|---|---|---|
| 45-3289 | 2/1970 | Japan | 425/464 |
| 51-7218 | 1/1976 | Japan | 264/237 |

*Primary Examiner*—Jay H. Woo

*Attorney, Agent, or Firm*—Frank M. Van Riet

[57] ABSTRACT

A spinnerette plate having multiple capillaries per counterbore can be effectively used to melt-spin fusion melts of acrylonitrile polymer and water without sticking together of individual filaments.

5 Claims, 2 Drawing Figures

CB-DIAMETER AS REQUIRED FOR AT LEAST ABOUT 18 C'BORES PER SQUARE CENTIMETER

Figure 1:
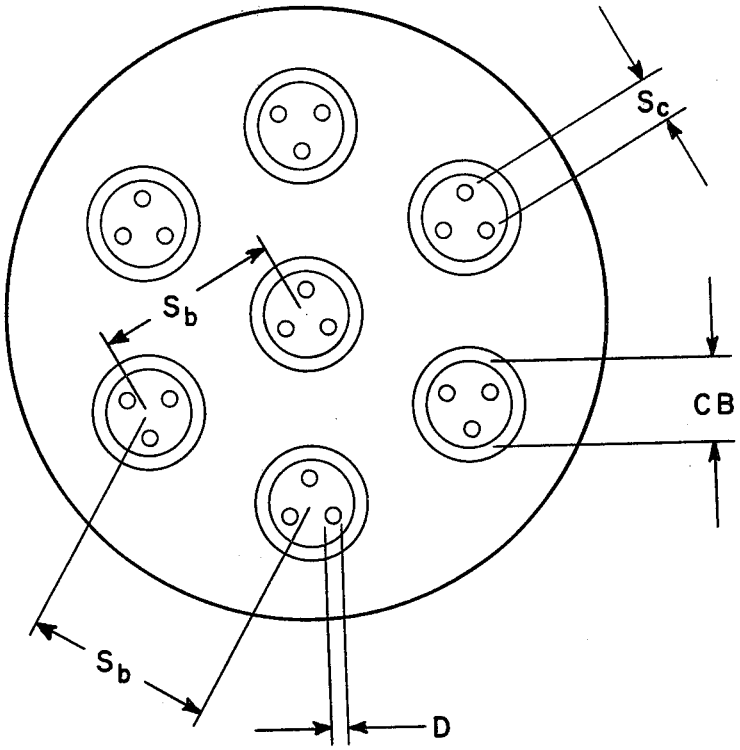

D—DIAMETER OF CAPILLARY $S_b/S_c$ AS REQUIRED FOR AT LEAST 50 CAPILLARIES PER SQUARE CENTIMETERS

SPINNERETTE PLATE HAVING MULTIPLE CAPILLARIES PER COUNTERBORE FOR MELT SPINNING FUSION MELTS OF ACRYLONITRILE POLYMER AND WATER

This is a continuation of application Ser. No. 938,202, filed Aug. 30, 1978 abandoned.

This invention relates to a spinnerette plate for melt-spinning fiber and to a melt-spinning process for preparing fiber using such spinnerette plate. More particularly, this invention relates to a spinnerette plate having a plurality of counterbores and at least three capillaries per counterbore and to the use thereof in melt-spinning fiber from a fusion melt of acrylonitrile polymer and water.

In conventional melt-spinning of fibers, a fiber-forming polymer is heated to a temperature at which it melts, is extruded through a spinnerette plate to form filaments which rapidly cool to become solid, and the resulting filaments are then further processed to provide the desired fiber. The spinnerette plate that is employed in such processing must contain capillaries to provide the desired filaments while satisfying two additional requirements. The capillaries must be of such dimensions as to satisfy back-pressure requirements and must be sufficiently spaced from one another as to prevent premature contact between the emerging filaments that would result in sticking together or fusion of filaments with one another. To reduce back-pressure, the capillaries are provided with counterbores of sufficient diameter and depth.

Recent developments in the field of fiber spinning, especially acrylic fibers, have led to the development of fusion melts which can be extruded through a spinnerette plate to provide filaments. These fusion melts comprise a homogeneous composition of a fiber-forming acrylonitrile polymer and water. Water enables the polymer to form a melt at a temperature below which the polymer would normally melt or decompose and becomes intimately associated with the molten polymer so that a single-phase melt results. Water must be used in proper proportions with the polymer to provide the single-phase fusion melt. Since the temperature at which the fusion melt forms is above the boiling point of water at atmospheric pressure, super-atmospheric pressures are necessary to keep water in the system. Such fusion melts have been effectively spun into fiber using spinnerette plates similar to those employed in conventional melt-spinning.

Because of the requirement for adequate spacing of the capillaries in spinnerette plates used for conventional melt-spinning to prevent premature contact between the nascent filaments which would result in their sticking together, the number of capillaries that can be provided in a given spinnerette plate is greatly restricted. As a result, production capacity of a spinnerette with a given surface area is limited and usually large tow bundles can only be produced by combining the outputs from a series of spinnerettes. This, in turn, requires costly installations of additional spinnerettes, specially designed conduits and spin packs to ensure an even distribution of the melt to all spinning holes, provision of space for installation, and further power consumption to operate the increased number of spinnerettes.

There exists, therefore, the need for a single spinnerette plate that would overcome the problems associated with prior art spinnerette plate assemblies and enable increased production to be obtained. There also exists the need for processes for providing fiber by melt spinning which enables the productivity of spinnerette plates to be increased. Such provisions would fulfill long-felt needs and constitute significant advances in the art.

In accordance with the present invention, there is provided a spinnerette plate having a plurality of counterbores and within each counterbore, at least about 3 capillaries, said capillaries being at a density of at least about 18 per square centimeter of plate surface.

In accordance with the present invention, there is also provided a process for melt-spinning an acrylonitrile polymer fiber which comprises providing a homogeneous fusion melt of a fiber-forming acrylonitrile polymer and water at a temperature above the boiling point of water at atmospheric pressure and at a temperature and pressure which maintains water and said polymer in a single phase and extruding said fusion melt through a spinnerette assembly containing a spinnerette plate having a plurality of counterbores and within each counterbore at least about 3 capillaries, said capillaries having a density of at least about 18 per square centimeter of plate surface and extruding said fusion melt directly into a steam-pressurized solidification zone maintained under conditions such that the rate of release of water from the nascent extrudate avoids deformation thereof.

The present invention by employing a fusion melt of fiber-forming acrylonitrile polymer and water at a temperature above the boiling point of water at atmospheric pressure and at a temperature and pressure that maintains water and the polymer in a single phase and by spinning said fusion melt directly into a steam-pressurized solidification zone that controls the rate of release of water from the nascent extrudate so that deformation thereof is avoided, filamentary extrudates are provided which do not stick together or become deformed as they emerge from the spinnerette capillaries. Since in this process the filaments have no tendency to stick together or deform as they emerge from the spinnerette, the counterbores of the spinnerette plate can be located closer together and more than one capillary can be provided in the counterbores. As a result, the productivity of the spinnerette can be greatly increased without negatively affecting the quality of the resulting fiber.

The spinnerette plate of the present invention, contains a number of capillaries located within each counterbore. The counterbores are necessary to enable the spinnerette plate to operate at a suitable level of back-pressure. The spinnerette plate as a whole will contain a substantially greater number of capillaries than the prior art spinnerette plates associated with melt spinning because the problem of sticking together of nascent extrudates is eliminated. Increased productivity is provided by increasing the density of capillaries in the spinnerette plate and the number of capillaries in each counterbore beyond the operative limits of conventional melt-spinning spinnerette plates which have restrictions as to hole density imposed by fusing of individual filaments.

It is possible to provide larger counterbores than are normally associated with a capillary and provide numerous capillaries therein although this has often been found to be unnecessary. It is preferable to provide a pattern of counterbores more closely spaced than those in the prior art spinnerette plates for melt spinning in a pattern providing uniform extrusion of the spinning melt through the spinnerette plate. The combination of more closely spaced counterbores with a plurality of capillaries within each counterbore gives rise to a substantial increase in the total number of capillaries for a given spinnerette surface, and hence in the productivity of the spinnerette.

Figure 2:
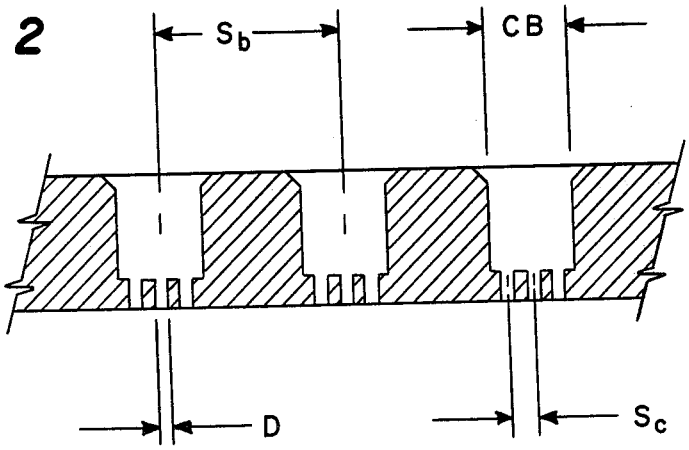

A typical spinnerette plate of the present invention is shown in the accompanying drawings, in which FIG. 1 represents a top view of the spinnerette plate showing the pattern of counterbores and capillaries therein and FIG. 2 shows a cross-sectional view of the same spinnerette plate showing details of the counterbores and capillaries.

In more detail, FIG. 1 shows a top view of the spinnerette plate in which CB represents the diameter of the counterbores as required for at least 18 counterbores per square centimeter, $S_b$ represents the spacings of counterbore centers, D represents the diameter of a capillary, $S_c$ represents the spacing of capillary centers, and the ratio $S_b/S_c$ is as required for at least 50 capillaries per square centimeter. FIG. 2 represents a cross-sectional view of the same spinnerette plate showing details of the counterbores and capillaries wherein CB, $S_b$, D and $S_c$ have the same meaning as in FIG. 1.

In carrying out the process of the present invention, it is necessary to provide a homogeneous fusion melt of a fiber-forming acrylonitrile polymer and water. Any fiber-forming acrylonitrile polymer that can form a fusion melt with water at a temperature above the boiling point of water at atmospheric pressure and at a pressure and temperature sufficient to maintain water and the polymer in a single fluid phase, can be used in the process of the present invention. Polymers falling into this category are known in the art. The fusion melt is prepared at a temperature above the boiling point at atmospheric pressure of water and eventually reaches a temperature and pressure sufficient to maintain water and the polymer in a single, fluid phase.

The homogeneous fusion melt thus provided is extruded through the spinnerette plate of the present invention directly into a steam-pressurized solidification zone that controls the rate of release of water from the nascent filaments so that deformation thereof is avoided and the process is able to provide filaments which solidify without sticking together one with another in spite of the close proximity of adjacent capillaries. The extruded filaments are processed according to conventional procedures to provide desirable filamentary materials which may have application in textile and other applications.

The pressurized solidification zone used in the process of the present invention is a critical feature of the process. If this pressurized solidification zone is omitted, water is so rapidly released from the nascent filaments which would emerge into atmospheric conditions that the filaments would become inflated or deformed and interfere with neighboring filaments and necessitate reduction in the number of operative spinnerette capillaries which would defeat the object of the invention. On the other hand, by employing the pressurized solidification zone operating at suitable steam pressure, the rate of release of water can be controlled as the nascent filaments solidify so that foaming and deformation thereof is avoided and optimum stretching is possible. The particular pressure of steam will vary widely depending upon the polymer employed, the spinning temperature employed and the like. The useful values for given systems are those values which minimize or avoid foaming or other forms of deformation of the filaments and provide optimum stretching. These values can readily be determined for any given system of polymer and water taking into account the teachings herein given.

A particularly preferred embodiment of the process of the present invention is drawing the nascent extrudate while it remains in the steam-pressurized solidification zone. Such drawing can be accomplished in one or more stretches and can eliminate any subsequent drawing normally required for fiber orientation. It is particularly preferred to conduct drawing in two stages with the stretch ratio of the second stage being larger than that of the first stage. It is also preferred to relax the drawn fiber in steam generally under conditions which provide from about 20% to 35% filament shrinkage.

The invention is more fully illustrated in the examples which follow, wherein all parts and percentages are by weight unless otherwise specified.

Kinematic molecular weight ($M_k$) is obtained from the following relationship: $\mu = 1/A\ M_k$ wherein $\mu$ is the average effluent time (t) in seconds for a solution of 1 gram of the polymer in 100 milliliters of 53 weight percent aqueous sodium thiocyanate solvent at 40° C. multiplied by the viscometer factor and A is the solution factor derived from a polymer of known molecular weight and in the present case is equal to 3,500.

EXAMPLE 1

A fusion melt of 15% water and 85% of an acrylonitrile polymer of the following composition was prepared at autogeneous pressure and 170° C.:

| | |
|---|---|
| Acrylonitrile | 89.3% |
| Methyl methacrylate | 10.7% |
| Molecular weight, kinematic | 58,000 |

The fusion melt was spun at 170° C. through a spinnerette assembly having orifice characteristics as follows:

| | |
|---|---|
| Capillary diameter | 200 microns |
| Capillary spacing[1] | 0.47 millimeters |
| Capillaries per counterbore | 7 |
| Counterbore diameter | 1.2 millimeters |
| Counterbore spacing[1] | 4.1 millimeters |
| Capillary density | 62 per sq. cm. |

[1]center to center

The extrusion was directly into a solidification zone pressurized with saturated steam at 15 pounds per square inch. The extruded filaments were stretched in a first stage at a stretch ratio of 3.8 and in a second stage at 6.7 for a total stretch of 25.5×. The filaments were dried at 138° C. and relaxed in steam at 116° C. Fiber of about 12 denier per filament was obtained having the following properties:

| | |
|---|---|
| Straight tenacity grams/denier | 3.4 |
| Straight elongation % | 35 |
| Loop tenacity grams/denier | 2.1 |
| Loop elongation % | 13 |

No sticking together of the filaments occurred and continuous processing was accomplished.

COMPARATIVE EXAMPLE A

Using the spinnerette assembly described in Example 1, a melt of polypropylene (Rexene Grade PP 3153) of fiber grade having a melt index of 3 dg/min. was prepared at 260° C. and extruded into static air at 25° C. The melt emerging from the spinnerette orifices merged to form macrofilaments from the union of the individual filaments issuing from single capillaries. Thus, filaments of the desired denier were not obtained using this spinnerette plate design.

EXAMPLE 2

The procedure of Example 1 was again followed with the following exceptions: The polymer had a kinematic molecular weight value of 40,000 and the spinnerette assembly had the following characteristics:

| | | |
|---|---|---|
| Capillary diameter | 85 | microns |
| Capillary spacing | 0.40 | millimeter |
| Capillary per counterbore | 19 | |
| Counterbore diameter | 2.0 | millimeters |
| Counterbore spacing | 1.4 | millimeters |
| Capillary density | 875 | per sq. cm. |

Continuous spinning was conducted with no sticking together or fusion of the individual filaments and fiber of substantially the same properties as obtained in Example 1 was obtained.

When the polypropylene melt described in Comparative Example A was extruded, extensive fusion of the individual filaments occurred and it was not possible to provide the desired filament denier.

EXAMPLES 3-5

Following the procedure of Example 1, a number of runs were made using spinnerette assemblies of different design in each run as shown in the table which also gives the example number. In each instance, continuous spinning was effected with no sticking together of the individual filaments.

TABLE

| | Capillaries | | | Counterbores | | |
|---|---|---|---|---|---|---|
| Example | Diameter[1] | Spacing[2] | Density[3] | Diameter[4] | Spacing[5] | Capillaries Per Counterbore |
| 3 | 85 | .42 | 213 | 1.0 | 1.2 | 3 |
| 4 | 85 | .59 | 87 | 1.2 | 2.8 | 5 |
| 5 | 85 | .47 | 337 | 1.2 | 1.4 | 7 |

[1]Microns
[2]Millimeters, center to center
[3]Holes per square centimeter
[4]Millimeters
[5]Millimeters, center to center

We claim:

1. A spinnerette plate having a plurality of counterbores and within each counterbore, at least about 3 capillaries, said capillaries being at a density of at least about 18 per square centimeter of plate surface and said counterbores being spaced center to center at a distance of less than about 5 millimeters.

2. The spinnerette plate of claim 1 having a capillary density of 62 per square centimeter.

3. The spinnerette plate of claim 1 having 7 capillaries per counterbore.

4. The spinnerette plate of claim 1 having a capillary density of 377 per square centimeter.

5. The spinnerette plate of claim 1 having 19 capillaries per counterbore.

* * * * *